US005213484A

United States Patent [19]

Hashimoto et al.

[11] Patent Number: 5,213,484

[45] Date of Patent: May 25, 1993

[54] DIAPHRAGM PUMP UNIT

[75] Inventors: Atsuki Hashimoto; Kenji Mizuno, both of Tokyo, Japan

[73] Assignee: Nitto Kohki Co., Ltd., Tokyo, Japan

[21] Appl. No.: 882,310

[22] Filed: May 13, 1992

[30] Foreign Application Priority Data

Jun. 7, 1991 [JP] Japan ..... 3-51126[U]

[51] Int. Cl.[5] ..... F04B 39/12

[52] U.S. Cl. ..... 417/312

[58] Field of Search ..... 417/312, 360

[56] References Cited

U.S. PATENT DOCUMENTS

| | | | |
|---|---|---|---|
| 4,950,133 | 8/1990 | Sargent | 417/312 |
| 4,988,268 | 1/1991 | Kurihara | 417/312 |
| 5,011,379 | 4/1991 | Hashimoto | 417/360 |
| 5,076,070 | 12/1991 | Takushima et al. | 415/419 |

*Primary Examiner*—Richard A. Bertsch
*Assistant Examiner*—Alfred Basichas
*Attorney, Agent, or Firm*—Kinney & Lange

[57] ABSTRACT

A pump body of a diaphragm pump unit comprises a housing and a pump placed therein, an elastic cover is attached to the housing so as to cover the upper portion of the housing. When the pump is operated with the upper opening of the housing of the pump body being covered with the cover, a fluid such as air is introduced into the housing through an inlet port made therein, flowing into a pressure chamber within the pump body. Since, at this time, the pressure in the housing becomes negative, an attraction force acts on the cover capping the upper portion of the pump body, whereby the cover is put in closer contact with the housing of the pump body to reduce noise leakage.

7 Claims, 3 Drawing Sheets

| SOURCE FREQUENCY | NOISE (dB(A)/m) | | | |
|---|---|---|---|---|
| | WITHOUT OUTER CASE 25 | | WITH OUTER CASE 25 | |
| | WITHOUT COVER 80 | WITH COVER 80 | WITHOUT COVER 80 | WITH COVER 80 |
| 50 (Hz) | 76.8 | 61.7 | 41.2 | 35.2 |
| 60 (Hz) | 77.0 | 62.6 | 43.1 | 37.0 |

DIAPHRAGM PUMP UNIT

BACKGROUND OF THE INVENTION

1. Field of the Invention

The present invention is related to a diaphragm pump unit, and more particularly to a diaphragm pump unit comprising a pump, and a housing for receiving the pump.

2. Description of the Prior Art

There have been various proposals for a pump unit in which a diaphragm pump for sucking and discharging a fluid is received and fixed in a housing, and a pump unit arrangement in which such pump unit is further received in an outer case through a noise insulating material. The pump body and housing therefor are described in detail in U.S. Pat. No. 5,011,379 specification, Japanese Utility Model Publication No. 42,448/1981 and Utility Model Application No. 167,747/1988 specifications and the like. The diaphragm pump described in U.S. Pat. No. 5,011,379 specification has many applications as the purifying bath for domestic use, and in this case, since the pump is placed outdoors and continuously operated the whole day, it is required to reduce the operation noise as much as possible.

SUMMARY OF THE INVENTION

The present invention was accomplished to meet the above-mentioned requirement and its object is to provide a diaphragm pump unit in which the operation noise can be reduced.

The present invention is characterized in that, in a pump body comprising a housing and a pump placed therein, an elastic cover is attached to the housing so as to cover the upper portion of the housing.

When the pump is operated with the upper opening of the housing of the pump body being covered with the cover, a fluid such as air is introduced into the housing through an inlet port made therein, flowing into a pressure chamber within the pump body. Since, at this time, the pressure in the housing becomes negative, an attraction force acts on the cover capping the upper portion of the pump body, whereby the cover is put in closer contact with the housing of the pump body to reduce noise leakage. If the pump body covered as described above with the elastic cover is further sealed in an outer case through a noise insulating material. Noise leakage is further decreased. The outer case can consist of a fluid tank to which the bottom of the housing is fixed through a vibration isolating material, and a casing fixed to the fluid tank so as to further cover the housing and elastic cover through a noise insulating material. The casing may also have an opening in the upper portion thereof, and a noise insulating filter for covering the opening can be fixed on the casing by a filter-attaching cap.

DETAILED DESCRIPTION OF THE PREFERRED EMBODIMENT

The present invention is now described in detail with reference to the drawings.

Figure 2:
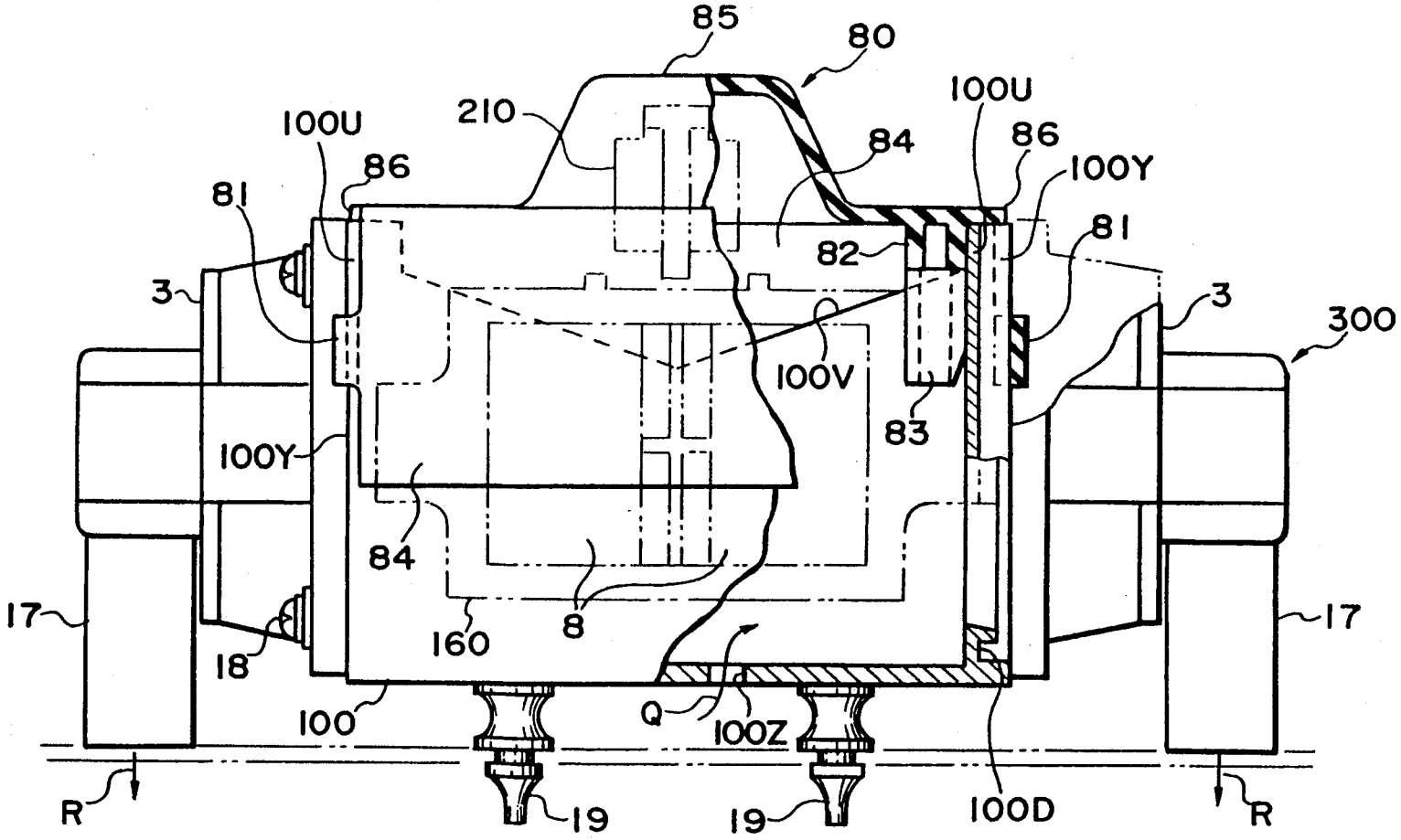
FIG. 2 is a partially cutaway front view of another embodiment of the present invention.
Figures 3, 4:
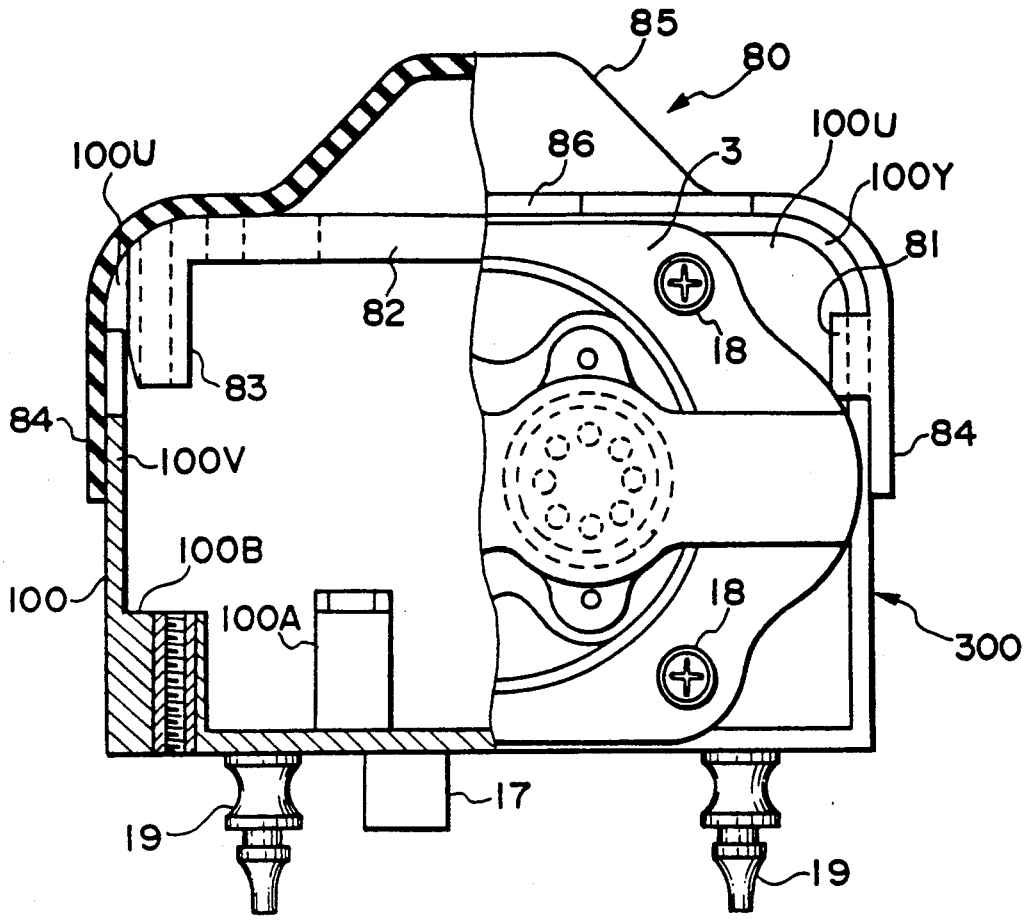
FIG. 3 is a partially cutaway left side view of the pump unit shown in FIG. 2.
FIG. 4 is a table showing experimental data of leakage noise for the pump body with and without a cover.

FIG. 2 is a partially cutaway front view of an embodiment of the present invention in which cover 80 is attached to pump body 300, and FIG. 3 is a partially cutaway left side view of the pump unit shown in FIG. 2. In these figures, the same symbols represent the same or identical portions. In FIGS. 2 and 3, for easy seeing of the figures, the internal structure in the cutaway portion of pump body 300 is omitted except for magnet 8 and magnet holder 160 shown by chain lines, and power supply switch 210.

Housing 100 may be a molded article by resin or a cast article by a metal such as aluminum. A pair of field cores and coils (not shown) are mounted on frames 100A and 100B (FIG. 3) fixed to the bottom of housing 100.

Plate-like magnet 8 is attached to magnet holder 160 formed of a material such as aluminum in a manner similar to the above-mentioned U.S. Pat. No. 5,011,379, and forms the vibrator of the pump body 300. The oscillator is attached to a diaphragm (not shown) the periphery of which is fitted into the fitting portion 100D of housing 100, so that it is placed between the pair of field cores.

Head cover 3, in which a compression chamber (not shown) for compressing and discharging a fluid by oscillation of the diaphragm is formed, is attached to the housing 100 by screws 18. The fluid (air) is sucked from fluid inlet port 100Z formed in the bottom of housing 100 as shown by arrow Q, and after passing through the inside of housing 100 and the compression chamber, discharged in the direction of arrow R through tube 17 attached to the head cover 3. Power supply switch 20 is useful for stopping the energization of the field coils if cracks or the like occur in the diaphragm material.

In this embodiment, cover 80 of an elastic material such as rubber, which covers the whole upper portion of housing 100, is attached so that the upper open portion of the housing is completely closed. The cover 80 has extended portions 84 extending along the side plates 100V of housing 100, and extended portions 84 are provided with hooks 81. By engaging the hooks 81 with ribs 100Y of housing 100, extended portions 84 are fixed to the upper portion of housing 100 with single touch of a finger. When it is fixed, the four projecting portions 83 formed in the corner portions of cover 80 are inserted into the four corners of housing 100, respectively, so that the fixing becomes more reliable.

This fixing allows the first seal portion 82 of cover 80 to abut on the side plate 100U of housing 100 and the second seal portion 84 to abut on the outer surface of side plate 100V, and thus the upper open portion of housing 100 can effectively and entirely be covered and sealed. As described later with reference to FIG. 1, when pump body 300 with cover 80 is placed in outer case 25 (FIG. 1), cover 80 is pressed by noise insulating material 21A toward housing 100, whereby the sealing properties of the housing by cover 80 are increased.

In addition, in operation of pump body 300, a fluid (air) is sucked into the housing via inlet port 100Z and fed under pressure from tube 17 to tank 20 via the compression chamber within head cover 3, which results in a negative pressure within housing 100. Accordingly, second seal portion 84 is pressed toward the outside of side plate, 100 V, whereby the above sealing is more ensured. Since projections 86 formed in cover 80 mount on the upper surface of the side plates 100U, the cover 80 is prevented from being pulled into housing 100 by the negative pressure in housing 100. The power supply switch 210 is received in switch receiving portion 85.

Figure 1:
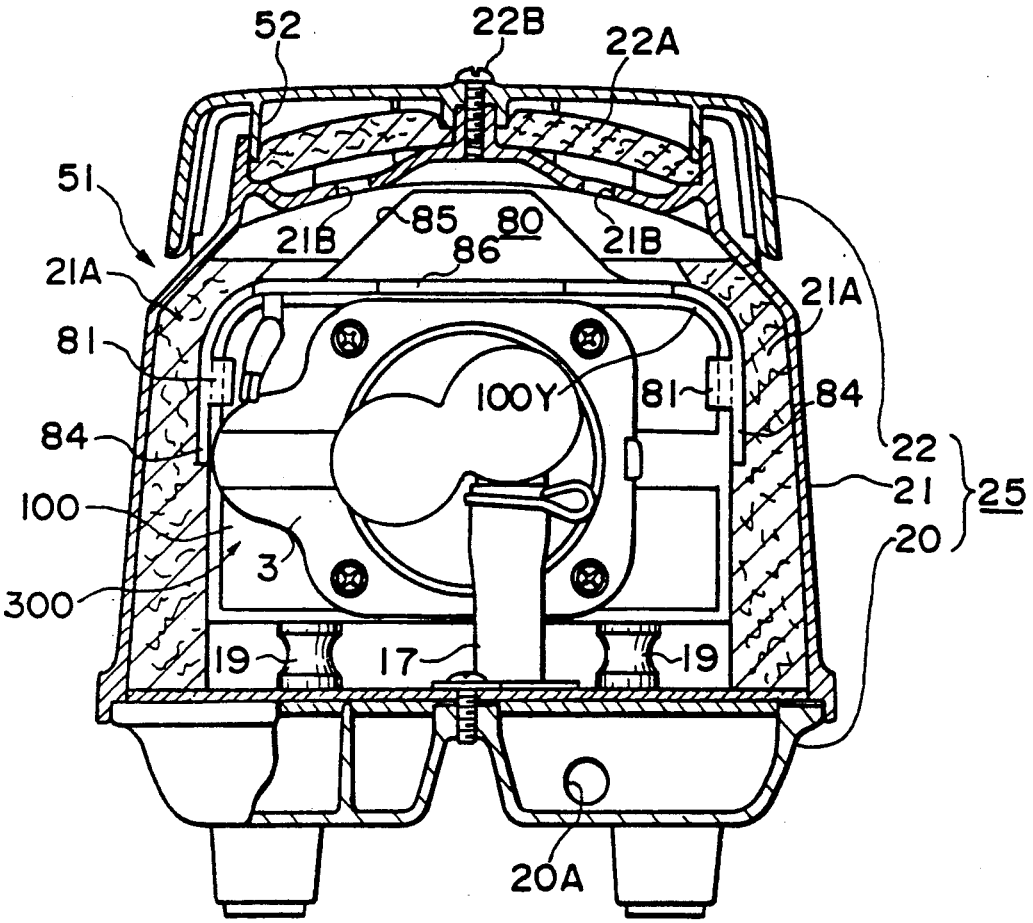
FIG. 1 is a longitudinal sectional view of an embodiment of the present invention.

FIG. 1 shows a longitudinal sectional view of another embodiment of the present invention, in which pump body 300 capped with cover 80 as described above is enclosed within outer case 25. In FIG. 1, the same symbols as FIGS. 2 and 3 represent the same or identical portions.

Pump body 300 is attached to fluid tank 20 with rubber vibration isolator 19 placed in-between. At this time, tube 17 connected to head cover 3 is connected to the tank 20. To fluid tank 20 which pump body 300 is attached to, casing 21 having noise insulating material 21A disposed on the inner periphery thereof is attached so as to cover the pump body 300 and cover 80, and filter-attaching cap 22 is attached by mounting screw 22B to the upper portion of casing 21 with noise insulating filter 22A placed in-between. The fluid tank 20, casing 21 and filter-attaching cap 22 constitute outer case 25.

Since, in the embodiment of FIG. 1, fluid inlet port 100Z (FIG. 2) is formed in the bottom of housing 100, the operation of pump body 300 allows a fluid to be introduced into casing 21 from the gap 51 between casing 21 and filter-attaching cap 22 through an opening (not shown) formed in pressing wall 52, filter 22A and the upper opening 21B of casing 21. The fluid in casing 21 is introduced into the compression chamber (not shown) within pump body 300 through fluid inlet port 100Z (FIG. 2) of the housing 100, and after compressed, it is discharged into fluid tank 20 via tube 17. The fluid discharged into fluid tank 20 is discharged to the outside from outlet port 20A and consumed.

In the above embodiment, a gap serving as a fluid passage may previously be formed between noise insulating material 21A and the housing of pump body 300 and/or cover 80. Since hooks 81 are formed in cover 80 as described above, the cover 80 can be attached to the pump body with single touch of a finger, but it may be fixed by a screw or the like instead of using hooks 81. In this case, if the housing is formed of resin, it is desirable to previously embed a (metallic) nut in the housing. Further, although the pump has been described as a diaphragm pump, it may be one of another types.

The present inventors experimentally measured the noise level in each pump with and without cover 80. The experiment result is shown in FIG. 4. The experiment was separately performed with and without outer case 25, and with power supply frequencies of 50 and 60 [Hz].

As obvious from FIG. 4, it is seen that noise greatly decreases independently of the existence of the outer case 25 if cover 80 is attached.

Since present invention comprises a cover which covers and closes the upper opening of a housing of a pump body that comprises a pump and the housing accommodating the pump therein, and a fluid inlet port is formed in the bottom wall of the housing, the effect of insulating the noise generated from the pump body is significant. Moreover, in the embodiment in which the pump body with a cover is further enclosed in the outer case, the air inspired in from the outside broadly passes the pump body and the outer periphery of the cover capping the upper opening of the pump body and is introduced into the housing, whereby a larger cooling effect is given. In addition, since the cover is formed of an elastic material such as rubber, installation is simple and excellent sealing properties are provided.

What is claimed is:

1. In a diaphragm pump unit comprising of a pump body which comprises a housing with an opening upper portion thereof and a pump received and fixed in said housing, a diaphragm pump unit comprising;

a fluid inlet port formed in the bottom wall of said housing, and an elastic cover provided as a cap to cover the opening in the upper portion of said housing. wherein said elastic cover is attracted and fixed to said housing be a negative pressure being generated when a fluid is inspired into the housing of the pump body through the fluid inlet port in response to driving of the pump.

2. A diaphragm pump unit as set forth in claim 1 wherein said elastic cover has extended portions downwardly extending along said housing on both sides in parallel with the oscillation direction of the diaphragm of the pump disposed within the housing, said extended portions of said cover being provided with hooks engaging with ribs of the housing.

3. A diaphragm pump unit of claim 1 wherein said pump body and the elastic cover capping the housing thereof are further received in an outer case, said outer case consisting of a fluid tank to which the bottom wall of the housing is fixed with a vibration isolating material placed in-between, and a casing which is fixed to the fluid tank so as further cover said housing and said elastic cover with a noise insulating material placed in-between.

4. A diaphragm pump unit of claim 3 wherein said casing further has an opening in the upper portion thereof, and a noise insulating filter covering said opening is fixed on said casing by a filter-attaching cap.

5. A diaphragm pump unit of claim 1 wherein said elastic cover is of a rubber material.

6. A diaphragm pump unit as set forth in claim 3 wherein said elastic cover has extended portions downwardly extending along said housing on both sides in parallel with the oscillation direction of the diaphragm of the pump disposed within the housing, said extended portions of said cover being sandwiched and fixed by said housing and the noise insulating material on the inside of the outer case.

7. A diaphragm pump unit of claim 6 wherein said extended portions of the elastic cover have a hook for engagement with the housing, and the housing has a rib portion formed therein for engagement with said hooks.

* * * * *